United States Patent [19]

Warren

[11] Patent Number: 5,063,852

[45] Date of Patent: Nov. 12, 1991

[54] FORWARD FULL CALIBER CONTROL TUBE FOR A CASED TELESCOPED AMMUNITION ROUND

[75] Inventor: J. Bruce Warren, Plymouth, Minn.

[73] Assignee: Alliant Techsystems Inc., Edina, Minn.

[21] Appl. No.: 613,255

[22] Filed: Nov. 14, 1990

[51] Int. Cl.[5] ..... F42B 5/045

[52] U.S. Cl. ..... 102/434; 102/464; 102/521

[58] Field of Search ..... 102/430, 433, 434, 435, 102/443, 464, 521

[56] References Cited

U.S. PATENT DOCUMENTS

| | | | |
|---|---|---|---|
| 4,715,284 | 12/1987 | Hendry | 102/434 |
| 4,802,415 | 2/1989 | Clarke et al. | 102/434 |
| 4,846,069 | 7/1989 | Tasson et al. | 102/434 |
| 4,858,533 | 8/1989 | Warren | 102/434 |

*Primary Examiner*—Harold J. Tudor

*Attorney, Agent, or Firm*—William T. Udseth; Edward W. Hughes

[57] ABSTRACT

A cased telescoped ammunition round 10 for a fin stabilized penetrator 32. A full caliber control tube 24 is positioned within casing 12, its forward end 28 being secured to front seal 22. The side walls 87 of control tube 24 are tapered, increasing in thickness from the free standing aft end 26 of control tube 24 to its forward end 28. Penetrator 32 and sabot 36 are positioned within control tube 24 with obturator band 46 and retaining groove 36 of aft bourrelet 36 positioned within control tube 24. Retaining groove 52 at the aft end of control tube 24 with split ring 50 and retaining groove 48 of aft bourrelet 36 retain sabot 34 and penetrator 32 within control tube 24 until round 10 is fired. Tapered side walls 87 minimize the volume of control tube 24 while assuring that side walls 87 are strong enough to withstand forces acting on control tube 24 forward of obturator band 46 when round 10 is fired.

14 Claims, 2 Drawing Sheets

FORWARD FULL CALIBER CONTROL TUBE FOR A CASED TELESCOPED AMMUNITION ROUND

BACKGROUND OF THE INVENTION (1) Field of the Invention

This invention is in the field of cased telescoped ammunition rounds, and more particularly relates to improvements to cased telescoped ammunition rounds with a full caliber control tube in which the projectiles are fin stabilized subcaliber penetrators, with the penetrator of each round being provided with a sabot which separates from the projectile as the projectile and sabot exit the barrel of the gun from which fired.

(2) Description of Related Art

A cased telescoped ammunition in which the projectile is completely enclosed, or telescoped, within the cartridge case, reduces the volume and weight of gun systems firing cased telescoped ammunition. The cylindrical shape of cased telescoped cartridges allows for a simpler more reliable and more compact gun system with a higher rate of fire compared with equivalent gun systems using conventionally shaped rounds.

Because of the advantages derived from using cased telescoped ammunition rounds, particularly rounds in which the projectile is a fin stabilized kinetic energy armor penetrating projectile, or penetrator, such rounds are commonly used in vehicle mounted gun systems to attack armored vehicles, fixed fortifications, and the like. An example of such a round is disclosed in U.S. Pat. No. 4,858,533 to Warren, which teaches a cased telescoped ammunition round with a full caliber control tube each end of which is respectively connected to the front and rear seals of the cylindrical casing of the round with a fin stabilized penetrator and its sabot positioned within the control tube prior to firing.

Since the dimensions of the casings of cased telescoped ammunition rounds fired by a given type gun system are fixed, then when the dimensions of the projectile and control tube are determined, the space available within the casing to be occupied by propellant is also fixed. To maximize the performance of a projectile there is a need to maximize the amount of propellant contained within each round by increasing the space available for propellant without reducing the reliability of the gun system while maintaining consistent performance of each round as fired.

SUMMARY OF THE INVENTION

The present invention provides an improved cased telescoped ammunition round for a fin stabilized penetrator projectile. The cylindrical casing has a rear seal closing the rear end of the casing and a front seal secured to the front end of the casing. A tapered full caliber control tube is secured to the front seal of the casing. The thickness of the side walls of the control tube increases, or the side walls are tapered, from the rear end to the forward end. A sabot which has a forward bourrelet and a rearward bourrelet is mounted around a fin stabilized penetrator. A centering band is located in a centering groove of the forward bourrelet, and an obturator band is positioned in an obturator groove of the rearward bourrelet. A retaining groove is also formed in the rearward bourrelet aft of the obturator groove.

The sabot and penetrator are positioned within the control tube. A retaining groove near the rear, or free end, of the control tube cooperates by means of a split ring with the retaining groove of the rearward bourrelet to prevent movement of the penetrator and sabot relative to the control tube and casing during normal handling of a round prior to its being fired. The main propellant is consolidated into a first cylindrical ring which is positioned within the casing and around the control tube, and a second cylindrical ring having an inner cylindrical surface which is positioned within the casing between the rear seal and the first ring of main propellant. A loose granular booster propellant is located within the space defined by the inner surface of the second ring of the main propellant, the rear seal, the sabot and the penetrator. An igniter is mounted in the rear seal for igniting the loose granular booster propellant which when activated forces the sabot and penetrator into the bore of the gun barrel of the gun from which the round is fired and ignites the main propellant.

A ring shaped package of an ablative grease may be positioned between the front seal and the front ring of the main propellant. When a package of an ablative grease is included in the round, bores are formed through the forward portion of the control tube proximate the front seal so that the ablative grease is injected into the control tube when the round is fired to coat the inner surfaces of the gun barrel of the gun system from which the round is fired. Including an appropriate amount of a suitable ablative in each round significantly reduces the rate of wear to which the gun barrel is subjected each time it is fired.

It is, therefore, an object of this invention to provide an improved cased telescoped ammunition round with a forward full caliber control tube in which the thickness of the side walls of the control tube increases from the rear free end of the control tube to its forward end which forward end is attached to the front seal of the casing to maximize the space within the casing available for propellant.

It is another object of this invention to provide an improved telescoped ammunition round with a forward full caliber tapered control tube with improved means for securing a sabot and penetrator within the control tube prior to firing the round.

It is yet another object of this invention to provide an improved telescoped ammunition round with a forward full caliber tapered control tube with an ablative grease positioned around the forward portion of the control tube with openings through the walls of the control tube through which the ablative grease is injected into the control tube to coat the bore of the gun from which the round is fired as the sabot and penetrator of the round accelerate down a gun barrel.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be affected without departing from the spirit and scope of the novel concepts of the disclosure, and in which.

DETAILED DESCRIPTION

Figure 1:
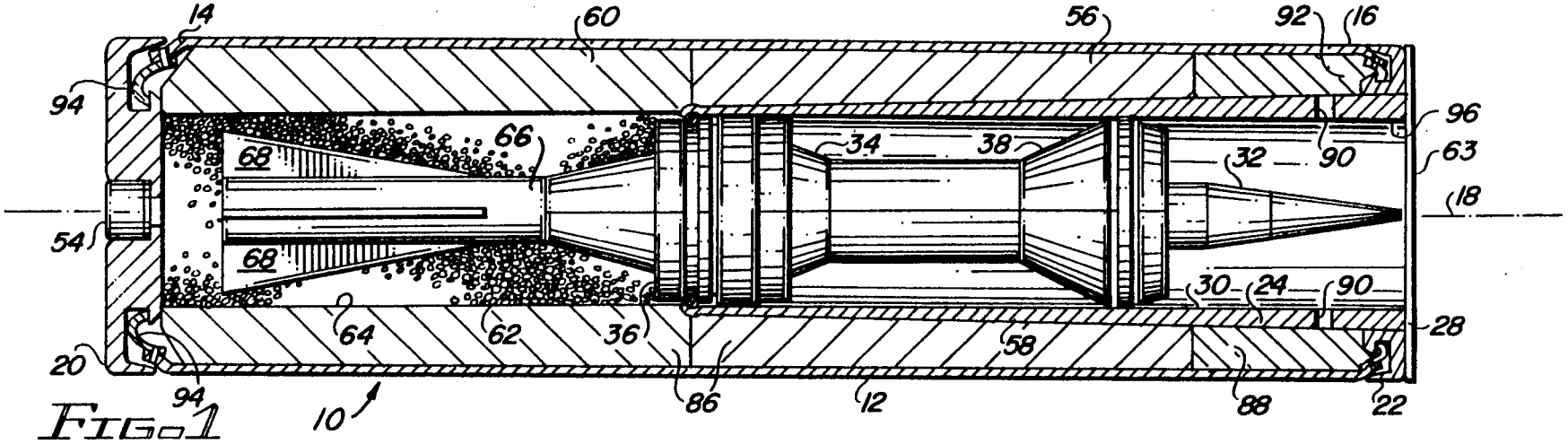
FIG. 1 is a sectional view of a preferred embodiment of cased telescoped ammunition round having a fin stabilized penetrator projectile and incorporating a forward full caliber tapered control tube.

In FIG. 1 cased telescoped ammunition round 10 has a right circular hollow cylindrical, or ring shaped, outer casing, or skin, 12. Outer casing 12 has a rear portion 14 and a front portion 16. Axis 18 of round 10 is also the axis of symmetry, or longitudinal, axis of casing 12. Rear seal 20 closes off rear end 14 of casing 12, and front seal 22 closes off front end 16 of casing 12. Control tube 24 is a forward full caliber control tube which is tapered from its rear, or free end, 26 to its forward end 28 for reasons set forth below.

The inner cylindrical surface 30 of control tube 24 has a diameter through out its entire length that is substantially the same as that of the bore of the barrel of the gun from which round 10 is fired, thus, it is a full caliber control tube. The forward end 28 of control tube 24 is appropriately secured to front seal 22 so that axis 18 of round 10 is also the axis of symmetry of control tube 24. The diameter of penetrator 32 which has a high length to diameter (L/D) ratio is substantially less than the diameter of the inner cylindrical surface 30 of control tube 24. To properly position penetrator 32 in core tube 24 and to prevent gun gas from flowing around, or bypassing, penetrator 32 when round 10 is fired from a conventional gun so that penetrator 32 exits the muzzle of the gun with maximum muzzle velocity, sabot 34 is mounted around penetrator 32. Sabot 34 has an aft, or rearward bourrelet 36 and a forward bourrelet 38. The diameters of the outer surfaces of bourrelets 36, 38 are substantially equal to that of the inner 30 surface of core tube 24 and the inner diameter of, or the caliber of, the bore of the gun from which round 10 is fired.

Figure 2:
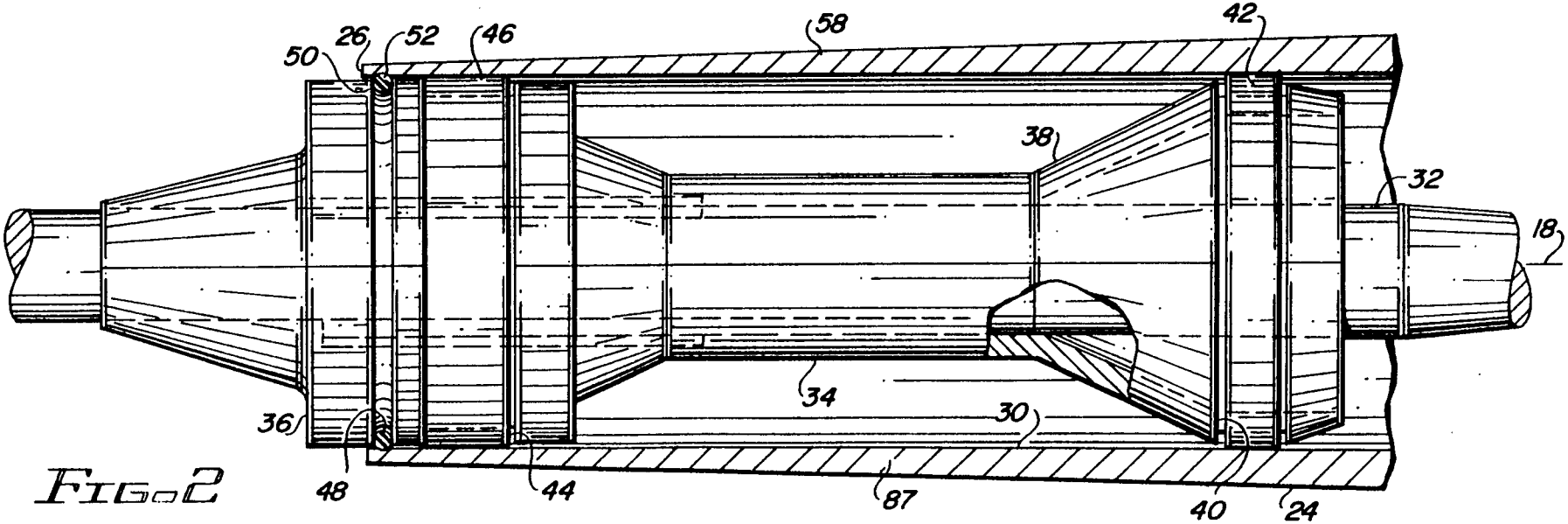
FIG. 2 is an enlarged elevation of the sabot and a portion of the penetrator, with the sabot positioned within the forward full caliber tapered control tube of the embodiment of FIG. 1.

A centering groove 40 is formed around forward bourrelet 38 and a centering band 42 is positioned in groove 40 as is best illustrated in FIG. 2. An obturator groove 44 is formed around rearward bourrelet 36 and an obturator band 46 is positioned in groove 44. A retaining groove 48 is also formed around aft bourrelet 36 rearward of obturator groove 44. A split retaining ring 50 is positioned in retaining groove 48 and cooperates with a similar retaining groove 52 formed in inner surface 30 of core tube 24 near its free end 26 to properly position sabot 34 and penetrator 32 in control tube 24. Split ring 50 and retaining grooves 48, 52 prevent movement of penetrator 32 and sabot 34 relative to control tube 24 and casing 12 when subjected to forces accompanying normal handling of round 10 prior to round 10 being fired.

The primary function of centering band 42 when round 10 is fired is to position forward bourrelet 38 and the forward portion of penetrator 32 in the center of control tube 24 with the axis of symmetry of penetrator 32 substantially aligned with axis of symmetry 18 of round 10 and of the bore of the gun barrel from which fired and to keep it so centered as sabot 34 and penetrator 32 are inserted into the bore of the gun fired and as they travel down the bore to the gun barrel's muzzle. The primary function of obturator band 46 is to prevent ignition products produced by the burning propellant, both booster and main, of round 10 from flowing past sabot 34 as sabot 34 and penetrator 32 accelerate down control tube 24 and the barrel of the gun from which round 10 is fired.

A primer 54 is mounted in rear seal 20 and is substantially centered on axis 18. A forward ring of consolidated main propellant 56 is positioned around the tapered outer surface 58 of control tube 24 and in substantial contact with surface 58. A rearward, or aft cylindrical ring of consolidated main propellant 60 is positioned within casing 12 between rear seal 20 and the forward ring of main propellant 56. A loose granular booster propellant 62 is positioned in the space defined by rear seal 20, the inner cylindrical surface 64 of the aft cylindrical ring of main propellant 60, rearward bourrelet 36, and the rearward portion 66 of penetrator 32 which includes the stabilizing fins 68.

In the preferred embodiment, booster propellant 62 is a granular propellant such as a single base, single perforation military grade propellant which facilitates loading booster propellant 62 into round 10, and main propellant rings 56, 60 are made by consolidating into an annulus, or ring, of the proper dimensions a single base single perforation military grade propellant. The central opening in front seal 22 is closed by environmental seal 63 which is made of a suitable material, such as aluminum foil. The function of seal 63 is to prevent elements of the environment external to round 10 such as moisture, dirt, etc. from entering round 10 and adversely impacting the performance of the round.

Figure 3:
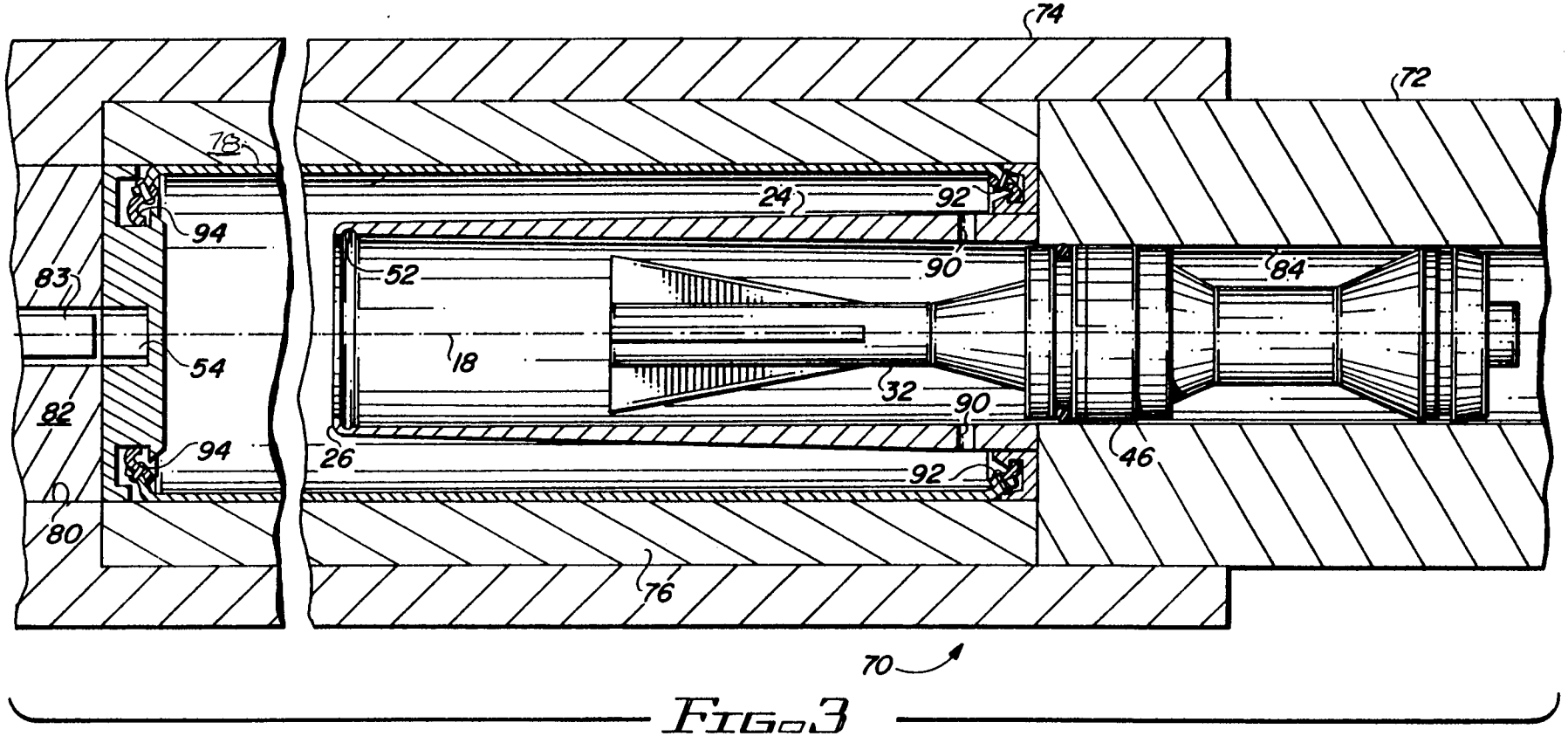
FIG. 3 is a section through a portion of a gun showing the position of the penetrator and its sabot of a round embodying this invention as they are being ejected from the control tube of the round into the barrel of a gun from which the round is being fired.

In FIG. 3, conventional gun 70 has its rifled barrel 72 fitted into breech block 74. Chamber liner 76 is positioned within breech block 74 aft of barrel 72. Round 10 is inserted into chamber 78 of gun 70 defined by the inner surface of chamber liner 76 through breech opening 80 in breech block 74; for example. After round 10 is loaded into chamber 78, bolt 82 closes opening 80. Centrally located in bolt 82 is a conventional firing mechanism 83. For example, firing mechanism 83 could drive a firing pin into primer 54 or discharge an electrical current through primer 54 to initiate primer 54 which when initiated ignites booster charge 62. Pressure of the gases produced by burning booster charge 62 act on the aft bourrelet 36 of sabot and the portions of penetrator 32 rearward of aft bourrelet 36 to accelerate projectile 32 and sabot 34 along a trajectory substantially coinciding with axis 18 of round 10.

The initial trajectory, or path, of penetrator 32 and sabot 34 is determined by core tube 24. The forces acting on projectile 32 and sabot 34 accelerate them down control tube 24 toward front seal 22 of round 10 and into the bore 84 of barrel 72. Obturator band 46 on aft bourrelet 36 of sabot 34 when it is within bore 84 of barrel 72 prevents gases produced by the ignited main propellant 86 which includes forward ring 5 and aft ring 60 and booster propellant 62 from flowing past bourrelet 36 so that sabot 34 and projectile 32 are accelerated to the desired muzzle velocity. It should be noted that the longitudinal axis of bore 84 substantially coincides with the axis 18 of round 10.

Since control tube 24 is secured only to front seal 16 of casing 12 and its length is such that only a small portion of tube 24 extends aft of obturator band 46, no ignition ports are formed through control tube 24 to determine when the main propellant charge 86 which includes forward ring 56 and aft ring 60 is ignited by booster propellant 62. Thus, another advantage of the relatively short length of control tube 24 is that main propellant charge 86 is pressurized and ignited earlier which improves the ballistic repeatability of rounds 10.

By using control tube 24 to guide sabot 34 and projectile 32 during that portion of the movement of sabot 34 during which it aft bourrelet 36 remains in contact with control tube 24, deviations of sabot 34 and projectile 32 from the desired trajectory are minimized. Further, no significantly unbalanced forces are applied to the structure of projectile 32 particularly aft of rearward bourrelet 36 of projectile 32 except those accelerating projectile 32 along axis 18, forces which projectile 32 and sabot 34 are designed to withstand.

As pointed out above the thickness of side walls 87 of control tube 24 increases from its free, or unsupported, end 26 to its forward end 28 by which control tube 24 is secured to front seal 16. The reason why control tube 24 is tapered is that control tube 24 must be able to withstand the rapidly increasing pressure of the gases produced by burning propellant 62, 86, or chamber pressure, acting on outer surface 58 of control tube 24 forward of obturator band 46 on the rear bourrelet 36 of sabot 34. As penetrator 32 and sabot 34 begin to move when booster propellant 62 is ignited by primer 54, obturator band 46 moves with them. Therefore, the portion of control tube 24 which must withstand the inward radially acting pressure decreases as sabot 32 moves. The pressure acting on the decreasing portion of control tube is a function of time beginning when round 10 is fired. The position of obturator band 46 on aft bourrelet 36 within control tube 24 is also a function of time beginning when round 10 is fired. The minimum thickness of side walls 87 of control tube 24 at any point along its length is, therefore, a function of the position of obturator band 46 within control tube 24 and of the chamber pressure, both of which are functions of time. The length of control tube 24 is minimized by making it just long enough to include obturator band 46 and retaining groove 48 of aft bourrelet 36 within control tube 24 when round 10 is assembled, and any time prior to round 10 being fired.

Tapered control tube 24 is a minimum volume solution to this problem and is calculated using interior ballistic measurements which establish the pressure that control tube 24 must withstand at any instant of time after firing. Estimates of projectile motion establish the position of obturator band 46 and thus, the portion of the control tube 24 subject to radial inward pressure at each such instant of time. Text book equations are used to determine the thickness of the walls of the control tube 24 forward of obturator band 46 at each such instant of time to withstand the pressure until obturator band 46 clears control tube 24. Tapered control tube 24 prevents the pressure of the burning propellant acting on control tube 24 in front of obturator band 46 as it moves through control tube 24 from causing control tube 24 to collapse, or to apply excessive pressure to sabot 34, the occurrence of either of which would have a deleterious impact on the operation of the gun while minimizing the volume occupied by control tube 34.

Because the volume of round 10 occupied by control tube 24, projectile 32, and sabot 34 is minimized, space within casing 12, for example, adjacent front seal 22 and around the exterior surface 58 of control tube 24 can be made available for ablative package 88 which contains a suitable ablative grease for lubricating bore 84 of gun barrel 72. Lubricant 88 enters the interior of control tube 24, through a plurality of bores, or openings, 90 formed in control tube 24. As the pressure of the gases produced by the burning propellants 62, 86 within casing 12 increases when round 10 is fired, the pressure quickly reaches a value where it is sufficient to force the ablative grease 88, typically a silicone grease, through bores 90 into control tube 24. Grease 88 is transported by sabot 34 into bore 84 of barrel 72 to coat the inner surface of barrel 72. The use of such a grease has the advantage of reducing the wear of the inner surface of barrel 72, and thus increases the number of rounds that can be fired by gun 70 before barrel 72 needs to be replaced.

In the preferred embodiment, control tube 24, casing 12 and end seals 20, 22 are made of high carbon steel. Round 10 is assembled by attaching casing 12 to front seal 22 by a plurality of spring clips 92 which are attached to the front portion 16 of casing 12. For a more complete description of the structure and function of clips 92 and how they are secured to casing 12 reference is made to U.S. Pat. No. 4,846,069 which issued on July 11, 1989. Control tube 24 may be secured to front seal 22 by a threaded connection. Projectile 32 and sabot are positioned in control tube 24 and held in place by split retaining ring 50 which occupies part of retaining groove 48 of aft bourrelet 36 and part of retaining groove 52 of control tube 24. Ablative package 88 is placed around control tube 24, within casing 12, and adjacent to front seal 22. Forward ring 56 of main propellant charge 86 is positioned immediately aft of lubricating package 88, with aft ring 60 of main propellant 86 being positioned rearward of ring 56. The space defined by the inner surface 64 of aft ring 60 not occupied by projectile 32 and sabot 34 is filled to the desired extent with booster propellant 62. The rear end of casing 12 is closed by securing rear seal 20 and igniter 54 to the rear portion 14 of casing 12 by spring clips 94, for example, which are similar in structure and function to spring clips 92. All joints between the seals 20, 22 and casing 12 are environmentally sealed by a sealant such as a room temperature vulcanizing silicone which is not illustrated, and the opening 96 in front seal 22 is closed by environmental seal 63.

From the foregoing it should be evident the forwardly mounted full tapered caliber control tube 12 of cased telescoped ammunition round 10 of this invention which is secured only to the forward seal 22 of casing 12 provides a control tube of minimum length and which occupies a minimum amount of the limited space available with cased telescoped round 10. Tapered control tube 24 is strong enough to resist collapse forward of obturating band 46 of aft bourrelet 36 of sabot 34 and to prevent excessive inward radial pressure from being applied to sabot 34 and penetrator 32 as the pressure of the gas produced by the burning propellants 62, 86 increases while concurrently sabot 34 and projectile 32 are being driven forward through control tube 24.

The additional space made available by the use of tapered control tube 24 provides space for a package of ablative grease 88 to be located forward of main propellant 86 while also increasing the volume within round 10 that can be occupied by propellant 62, 86 to increase the muzzle velocity of each round. Obviously various modification can be made to the described invention without departing from the scope of the present invention. The appendant claims are therefore intended to cover and embrace any such modifications within the limits only of the true spirit and scope of the invention.

What is claimed is:

1. A cased telescoped ammunition round comprising:

a casing having a front portion and a rear portion;
a real seal closing the rear portion of the casing;
a front seal secured to the front end of the casing;
a fin stabilized penetrator;
a sabot mounted on the penetrator, the sabot having a forward bourrelet and an aft bourrelet, an obturator band mounted on the aft bourrelet, and retention means located on the aft bourrelet aft of the obturator band;
a forward full caliber tapered control tube positioned within the casing and secured to the front seal, the control tube having an aft end, a front end and side walls which increase in thickness from the aft end of the control tube to the front end of the control tube, the sabot being positioned in the control tube with the obturator band of the aft bourrelet within the control tube;
retention means positioned within the control tube for cooperating with the retention means of the aft bourrelet to retain the sabot and the penetrator within the control tube during normal handling;
a first consolidated ring of main propellant positioned around the control tube within the casing;
a second consolidated ring of main propellant positioned within the casing between the rear seal and the first ring of the main propellant;
a booster propellant positioned in the space defined by an inner surface of the second propellant ring, the rear seal, the sabot and the penetrator; and
primer means mounted in the rear seal for igniting the booster, propellant; the booster propellant, when initiated, igniting the main propellant.

2. The cased telescoped ammunition round as set forth in claim 1, in which the thickness of the side walls of the control tube is substantially the minimum thickness from its aft end to its front end to withstand the pressure of gases produced by the ignited propellant acting on the outer surface of the control tube from the position of the obturator band within the control tube to its front end until the obturator band exits the control tube, when the round is fired.

3. A cased telescoped ammunition round as set forth in claim 2 in which the retention means of the control tube is a retaining groove formed near the aft end of the control tube and a split retaining ring, and the retention means of the sabot is the retaining groove of the aft bourrelet.

4. The cased telescoped ammunition round of claim 3 further comprising: a package of ablative grease positioned within the casing, around the control tube, and between the front seal and the front ring of the propellant; and a plurality of bores formed through the side walls of the control tube proximate the front seal to permit the ablative grease to be injected into the control tube when the round is fired.

5. A cased telescoped ammunition round as set forth in claim 4, in which the second consolidated ring of the main propellant has a substantially cylindrical inner surface.

6. A cased telescoped ammunition round as set forth in claim 5, in which the booster propellant comprises loose granules of a single base perforation military grade propellant.

7. A cased telescoped ammunition round comprising:
a casing having a front end and a rear end;
a rear seal closing the rear end of the casing;
a front seal mounted on the front end of the casing;
a fin stabilized penetrator;
a sabot mounted on the penetrator, said sabot having a front bourrelet and a rear bourrelet, an obturator band mounted on the rear bourrelet and a retaining groove formed on the rear bourrelet aft of the obturator band;
a full caliber tapered control tube having side walls positioned within the casing, said control tube having a rear free end and a front end, the front end of the control tube being connected to the front seal; the thickness of the side walls of the control tube increasing from its free end to its front end so that the control tube occupies a minimum volume and is strong enough to withstand forces acting on the control tube after the round is fired and prior to the sabot exiting the control tube, the sabot being positioned in the control tube with the obturator band on the rear bourrelet within the control tube;
retaining means positioned within the control tube and proximate the free end of the control tube for cooperating with the retaining groove of the rear bourrelet to secure the sabot and the penetrator within the control tube until the round is fired;
a first consolidated ring of a main propellant positioned around the control tube within the casing;
a second consolidated ring of main propellant having a substantially cylindrical inner surface, the second consolidated ring of the main propellant being positioned within the casing, between the rear seal, and the first ring of main propellant;
a booster propellant positioned in the space defined by the inner surface of the second propellant ring, the rear seal, the sabot, and the penetrator; and
a primer mounted in the rear seal for igniting the booster propellant, the booster propellant, when initiated, igniting the main propellant.

8. A cased telescoped ammunition round as set forth in claim 7 in which the retaining means positioned within the control tube include a retaining groove and a split retaining ring.

9. A cased telescoped ammunition round as set forth in claim 8 further comprising a package of ablative grease positioned within the casing, around the control tube and between the front seal and the first consolidated ring of propellant; and a plurality of bores formed through the side walls of the control tube proximate the front seal to permit the ablative grease to be injected into the control tube when the round is fired.

10. A cased telescoped ammunition round as set forth in claim 9 in which the booster propellant comprises loose granules of a single base single perforation military grade propellant.

11. A cased telescoped ammunition round comprising:
a casing having a rearward portion and a forward portion, an axis of symmetry, and forming a substantially right circular ring;
a rear seal for closing the rearward portion of the casing;
a front seal secured to the forward portion of the casing;
a forward full caliber control tube having side walls, a rearward end and forward end, and a length, the thickness of the side walls of the control tube increasing from the rearward end to the forward end, the forward end of the control tube being secured to the front seal;

a fin stabilized penetrator having a pointed tip at one end and a plurality of stabilizing fins mounted at the other end;

a sabot mounted on the fin stabilized penetrator, said sabot having a forward bourrelet and a rearward bourrelet, a centering band positioned in a centering groove of the forward bourrelet, an obturator band positioned in an obturator groove of the rearward bourrelet, a retaining groove formed in the rearward bourrelet rearward of the obturating groove, the sabot and the penetrator being positioned in the control tube;

retaining means located proximate the rearward end of the control tube for cooperating with the retaining groove of the rearward bourrelet to prevent movement of the penetrator and the sabot relative to the control tube and the casing during normal handling of the round prior to the round being fired;

a first consolidated ring of a main propellant positioned within the casing and around the control tube;

a second consolidated ring of main propellant having a substantially cylindrical inner surface, the second ring of main propellant being positioned within the casing between the rear seal and the first ring of main propellant;

booster propellant means positioned within the space defined by the inner surface of the second ring of main propellant, the rear seal, the rearward bourrelet of the sabot, and the penetrator; and an igniter mounted on the rear seal for igniting the booster propellant when the igniter is initiated, the initiated booster propellant igniting the main propellant to accelerate the sabot and the penetrator along a trajectory substantially coinciding with the axis of symmetry of the casing.

12. A cased telescoped ammunition round as set forth in claim 11 in which the retaining means of the control tube is a retaining groove formed near the rearward end of the control tube and a split retaining ring.

13. The cased telescoped ammunition round of claim 12 further comprising: a package of ablative grease positioned within the casing, around the control tube, and between the front seal and the front ring of propellant; and a plurality of bores formed through the side walls of the control tube proximate the front seal to permit the ablative grease to be injected into the control tube when the round is fired.

14. A cased telescoped ammunition round as set forth in claim 13, in which the booster propellant means comprises loose granules of a single base single perforation military grade propellant.

* * * * *